US011364410B2

(12) United States Patent
Hsu

(10) Patent No.: US 11,364,410 B2
(45) Date of Patent: Jun. 21, 2022

(54) DUAL-TURNTABLE TRAINING DEVICE

(71) Applicant: GREAT FITNESS INDUSTRIAL CO., LTD., Tainan (TW)

(72) Inventor: Chih-Yung Hsu, Tainan (TW)

(73) Assignee: Great Fitness Industrial Co., Ltd., Tainan (TW)

( * ) Notice: Subject to any disclaimer, the term of this patent is extended or adjusted under 35 U.S.C. 154(b) by 72 days.

(21) Appl. No.: 16/941,752

(22) Filed: Jul. 29, 2020

(65) Prior Publication Data

US 2021/0205655 A1 Jul. 8, 2021

(30) Foreign Application Priority Data

Jan. 2, 2020 (TW) ..... 109200036
Jul. 15, 2020 (TW) ..... 109209029

(51) Int. Cl.
*A63B 21/015* (2006.01)
*A63B 21/00* (2006.01)
*A63B 22/00* (2006.01)

(52) U.S. Cl.
CPC .... *A63B 21/4049* (2015.10); *A63B 21/00069* (2013.01); *A63B 21/00192* (2013.01);
(Continued)

(58) Field of Classification Search
CPC ..... A63B 21/4049; A63B 21/00069; A63B 21/00192; A63B 21/015; A63B 21/4035;
(Continued)

(56) References Cited

U.S. PATENT DOCUMENTS 4,784,385 A * 11/1988 D'Angelo ..... A63B 21/0084 482/111
2008/0076644 A1* 3/2008 Rutherford ..... A63B 21/22 482/114

FOREIGN PATENT DOCUMENTS

CN 2675187 Y * 2/2005
DE 202009016270 U1 * 3/2010 ..... A63B 22/0002
(Continued)

OTHER PUBLICATIONS

Playparc Allwetter-Freizeit-Anlagenbau GmbH, DE 202009016270 U1 Translation (Year: 2021).*
(Continued)

*Primary Examiner* — Erin Deery
*Assistant Examiner* — Robert Matthew Budzyn
(74) *Attorney, Agent, or Firm* — Rosenberg, Klein & Lee

(57) ABSTRACT

A dual-turntable training device includes a base, two turntable units, and a resistance unit. Each turntable unit includes a rotating shaft, a turntable, and a grip. The rotating shaft is pivoted to the base. The turntable is secured to the rotating shaft. The two turntables of the two turntable units are horizontally arranged side by side. The grip is vertically disposed on the turntable. The resistance unit includes a control member and two resistance members. The control member is disposed on the base. The control member is connected to the two resistance members. The two resistance members correspond to the two turntables and are configured to apply rotation resistance to the two turntables. By operating the control member, the two resistance members are moved closer to or away from the two turntables for adjusting the rotation resistance.

6 Claims, 9 Drawing Sheets

(52) U.S. Cl.
CPC ..... *A63B 21/015* (2013.01); *A63B 21/4035* (2015.10); *A63B 22/0005* (2015.10)

(58) Field of Classification Search
CPC ..... A63B 22/14; A63B 22/0005; A63B 23/12; A63B 2225/09; A63B 21/005; A63B 21/0051; A63B 21/012; A63B 21/0125; A63B 21/151; A63B 21/152; A63B 21/153; A63B 21/154; A63B 21/155; A63B 21/156; A63B 21/22; A63B 21/222; A63B 21/4019; A63B 21/4021; A63B 21/4033; A63B 22/06; A63B 22/0605
See application file for complete search history.

(56) References Cited

FOREIGN PATENT DOCUMENTS

| | | | | |
|---|---|---|---|---|
| DE | 202009016270 U1 * | 4/2010 | ..... | A63B 21/00069 |
| EP | 3335767 A1 * | 6/2018 | ..... | A63B 22/0605 |

OTHER PUBLICATIONS

Liao, Xue-Jin, CN 2675187 Y Translation (Year: 2021).*
Pflanz, Stefan; Pflanz, Gero, EP 3335767 A1 Translation (Year: 2021).*
Playparc Allwetter-Freizeit-Anlagenbau GmbH, DE-202009016270 Translation (Year: 2010).*

* cited by examiner

DUAL-TURNTABLE TRAINING DEVICE

FIELD OF THE INVENTION

The present invention relates to a dual-turntable training device, and more particularly to a training device having two turntable units that are arranged side by side to improve training intensity through a resistance unit.

BACKGROUND OF THE INVENTION

Nowadays, sports are becoming more and more popular, not limited to outdoor sports. In general, indoor exercise equipment includes treadmills, exercise bikes, elliptical machines, and so on. The above-mentioned exercise equipment can only exercise the lower body muscles, and the upper body cannot be fully exercised. People may exercise their upper body by lifting barbells or dumbbells. Lifting barbells or dumbbells is too heavy for the elderly and younger. The rotating wheels or massage devices in the park do not have resistance units, so the training intensity is not high enough.

SUMMARY OF THE INVENTION

The primary object of the present invention is to provide a dual-turntable training device, comprising a base, two turntable units, and a resistance unit. Each turntable unit includes a rotating shaft, a turntable, and a grip. The rotating shaft is pivoted to the base. The turntable is secured to the rotating shaft. The two turntables of the two turntable units are horizontally arranged side by side. The grip is vertically disposed on the turntable. The resistance unit includes a control member and two resistance members. The control member is disposed on the base. The control member is connected to the two resistance members. The two resistance members correspond to the two turntables and are configured to apply rotation resistance to the two turntables. By operating the control member, the two resistance members are moved closer to or away from the two turntables for adjusting the rotation resistance.

Preferably, the base includes a fixing seat and a connecting member. The connecting member is pivotally connected to the fixing seat through a pivot. The two turntable units are disposed on the connecting member.

Preferably, the pivot is pivoted to the fixing seat in a horizontal direction. The pivot is arranged in a direction same as that of the turntable.

Preferably, the connecting member has a U-shaped rod and a horizontal rod. The U-shaped rod has two end portions. The horizontal rod is fixed to the end portions. The horizontal rod has a through hole. The through hole is provided with a nut. The control member is screwed in and connected to the nut. The two turntable units are disposed on two sides of the horizontal rod, respectively. When the control member is screwed into the nut, the two resistance members are moved close to the two turntables to generate the rotation resistance.

Preferably, the resistance unit further includes a movable rod and a fixing member. The control member is connected to the movable rod. The two resistance members are disposed on two sides of the movable rod, respectively. The fixing member is inserted through the horizontal rod and the movable rod. When the control member is inserted into the nut, the movable rod cannot be turned.

Preferably, the control member has a control portion and a control rod. The control rod has a threaded portion and an insertion portion. The threaded portion is screwed to the nut. The insertion portion is inserted through the movable rod. A stepped surface is defined between the threaded portion and the insertion portion. When the threaded portion is screwed into the nut by turning the control member, the insertion portion is idle relative to the movable rod, and the stepped surface is pushed against the movable rod to control the two resistance members to approach the two turntables.

Preferably, the grip has a height ranging from 8 cm to 16 cm.

Preferably, the resistance members are magnetic resistance members or friction members.

The above technical features have the following advantages:

1. In the present invention, the turntables of the two turntable units are horizontally arranged side by side. The operator can operate the training device with both of his/her both hands or one hand. The two turntables are provided with the resistance unit. The operator can adjust the control member of the resistance unit for the two resistance members to apply rotation resistance to the two turntables, thereby improving the training intensity with the rotation resistance for the operator.
2. In the present invention, the connecting member is pivotally connected to the fixing seat through the pivot, so that the two turntable units can pivot an angle. By pivoting the angle, the operator can choose to stand or sit for training.
3. In the present invention, the height of the grip is between 8 cm and 16 cm. The operator can hold the grip in the palm of their hand or hold the grip with his/her fingers for training.
4. In the present invention, the two resistance members can selectively use magnetic resistance members or friction members to generate rotation resistance according to the training intensity and the operating habits of the operator.

DETAILED DESCRIPTION OF THE PREFERRED EMBODIMENTS

Embodiments of the present invention will now be described, by way of example only, with reference to the accompanying drawings.

Figure 1:
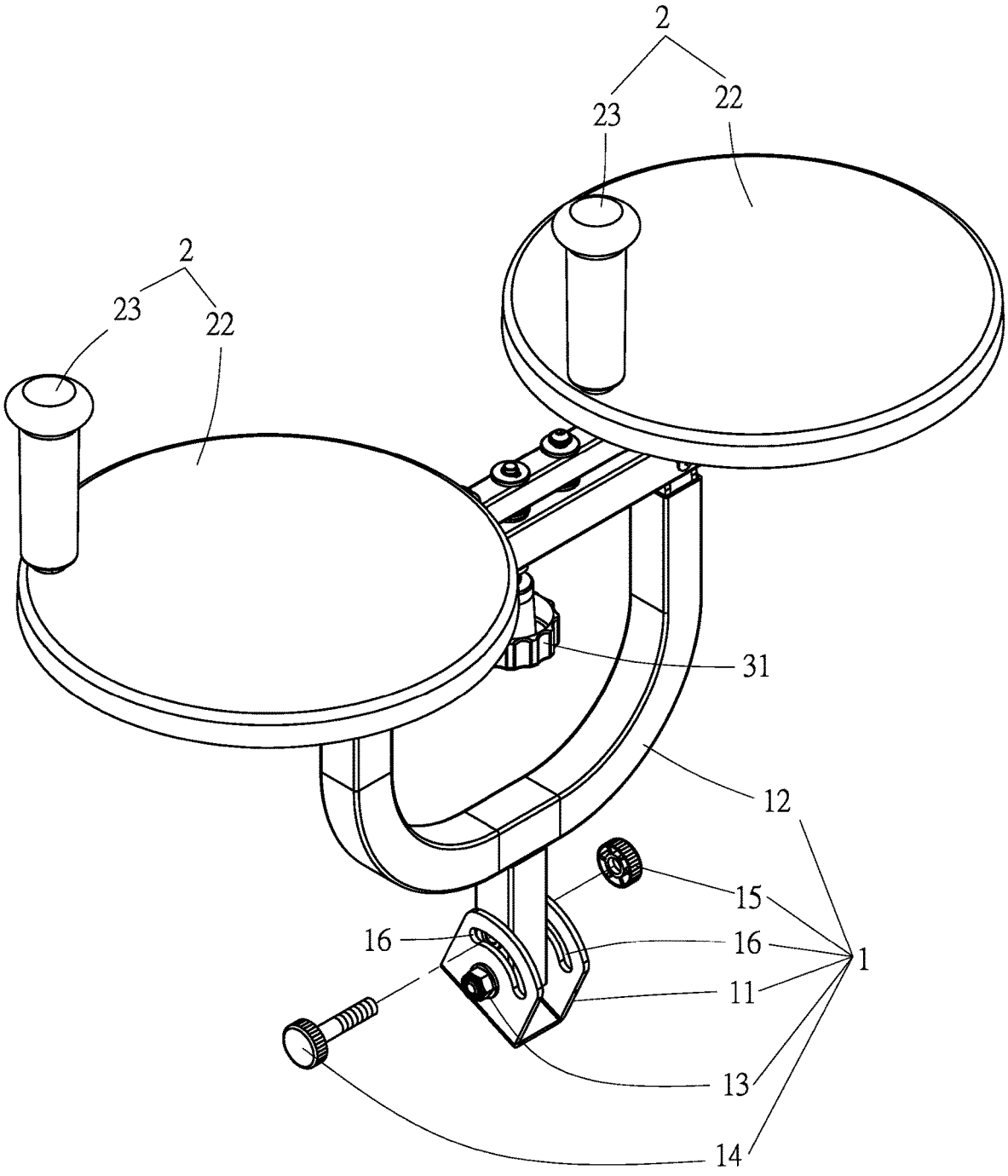
FIG. 1 is a perspective view of the dual-turntable training device of the present invention.
Figure 2:
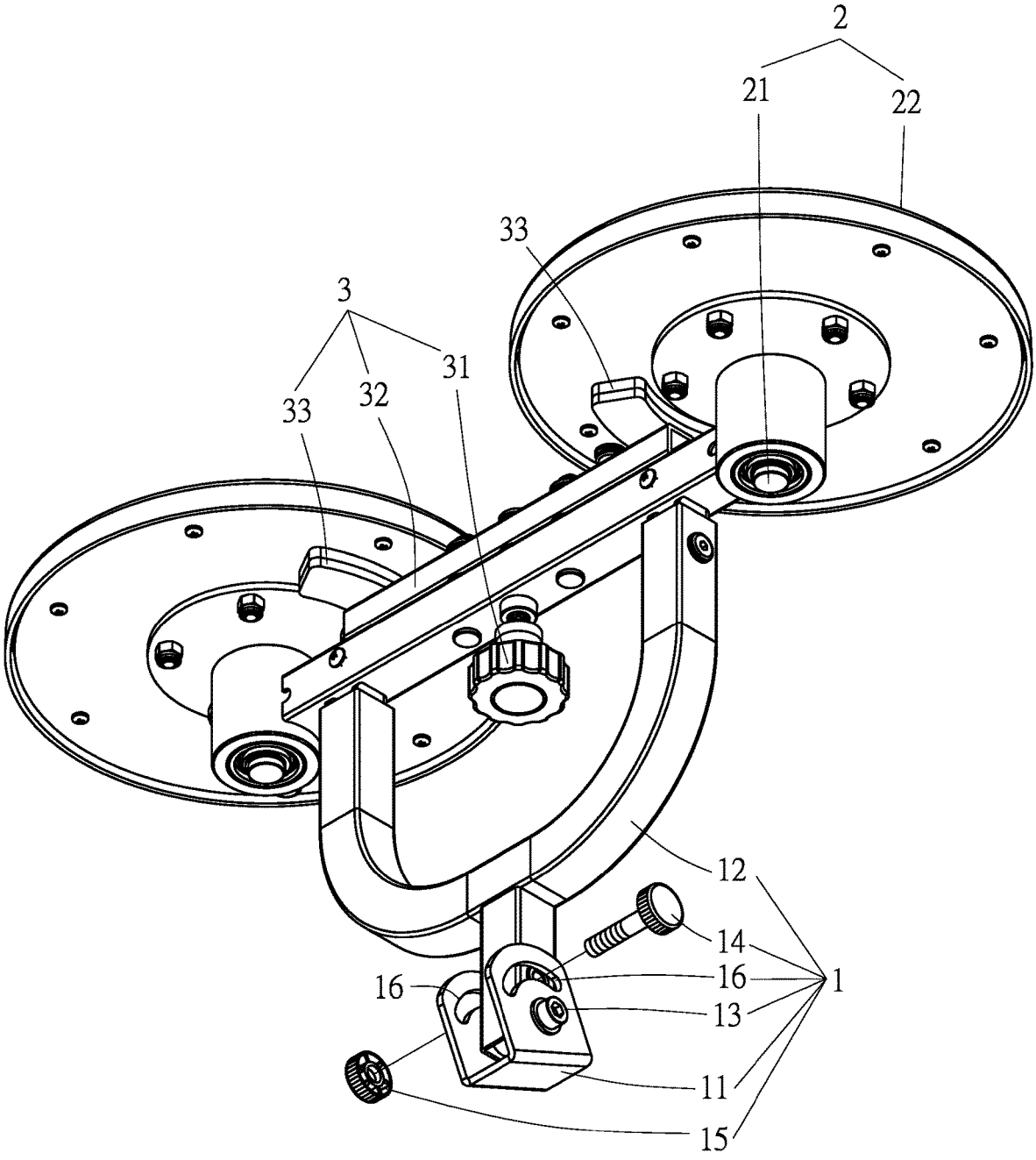
FIG. 2 is another perspective view of the dual-turntable training device of the present invention.

As shown in FIG. 1 and FIG. 2, a dual-turntable training device comprises a base 1, two turntable units 2, and a resistance unit 3. The base 1 includes a fixing seat 11, a connecting member 12, a pivot 13, a screw 14, a nut 15, and a pair of pivot grooves 16. The pivot 13 is pivoted to the fixing seat 11 in a horizontal direction. The connecting member 12 is pivotally connected to the fixing seat 11 through the pivot 13. The pivot grooves 16 are disposed on two sides of the fixing seat 11, respectively. The pivot grooves 16 are arc-shaped. The screw 14 is inserted through the pair of pivot grooves 16 of the fixing seat 11 and screwed to the nut 15, so that the connecting member 12 is fixed to the fixing seat 11. Each turntable unit 2 includes a rotating shaft 21, a turntable 22, and a grip 23. The rotating shaft 21 is pivoted to the connecting member 12. The turntable 22 is secured to the rotating shaft 21. The turntables 22 of the two turntable units 2 are horizontally arranged side by side. The turntable 22 and the pivot 13 are arranged in the same direction. The grip 23 is rotatably disposed on the turntable 22. The resistance unit 3 includes a control member 31, a movable rod 32, and two resistance members 33. The control member 31 is connected to the connecting member 12. The movable rod 32 connects the control member 31 and the two resistance members 33. The two resistance members 33 correspond to the two turntables 22.

Figure 3:
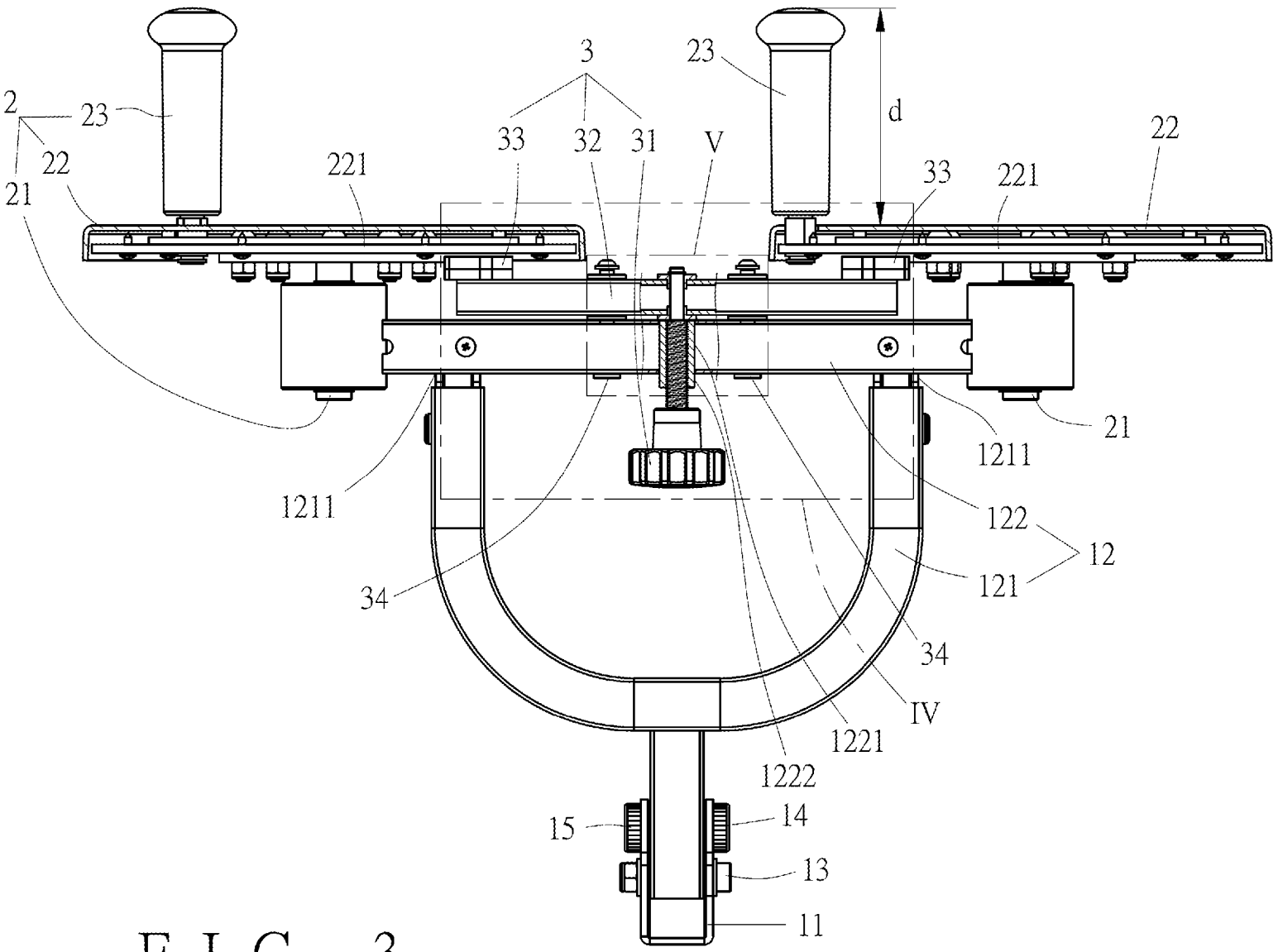
FIG. 3 is a cross-sectional view of the dual-turntable training device of the present invention.
Figure 4:
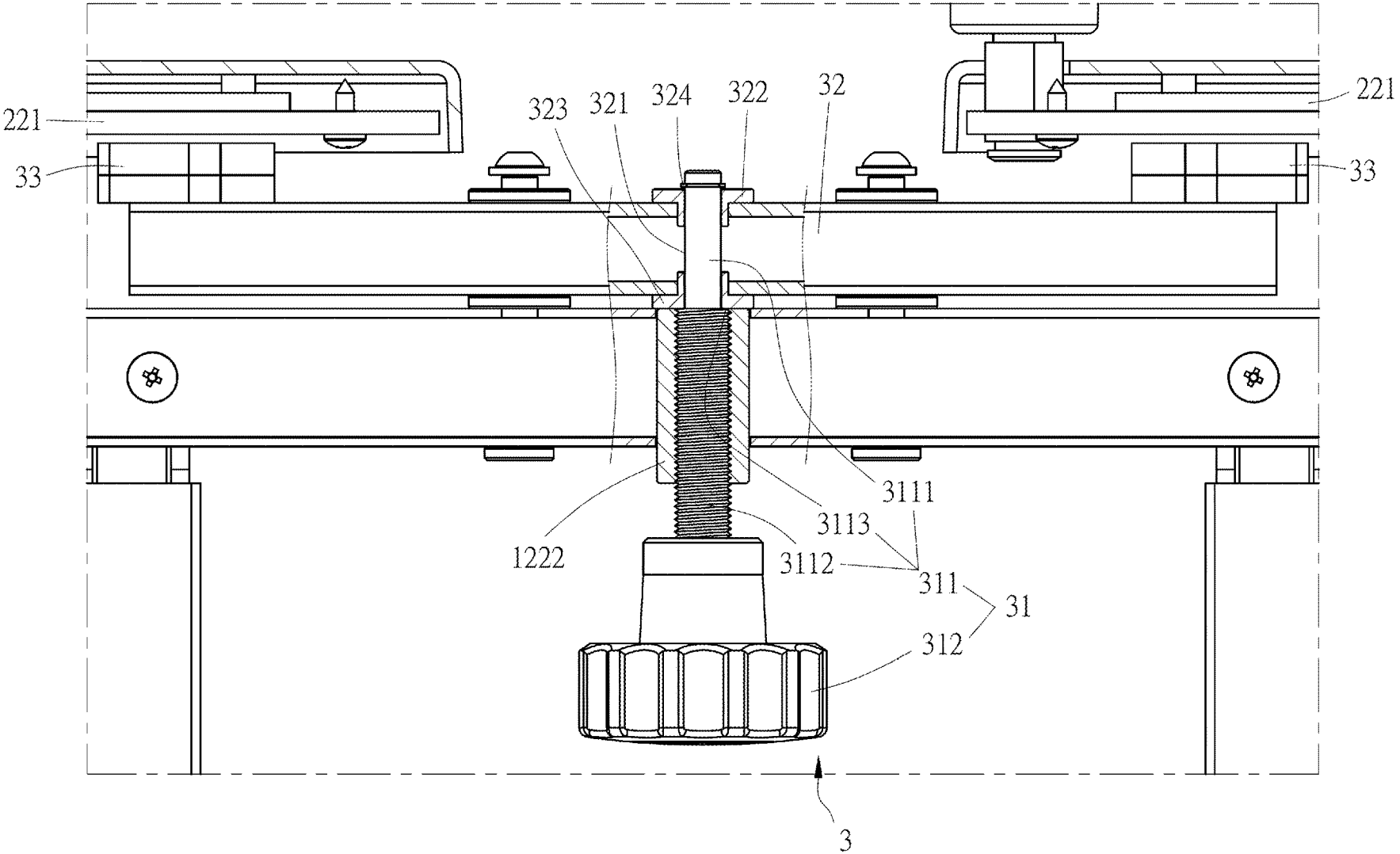
FIG. 4 is a partial enlarged view of the resistance unit and the connecting member of the present invention.
Figure 5:
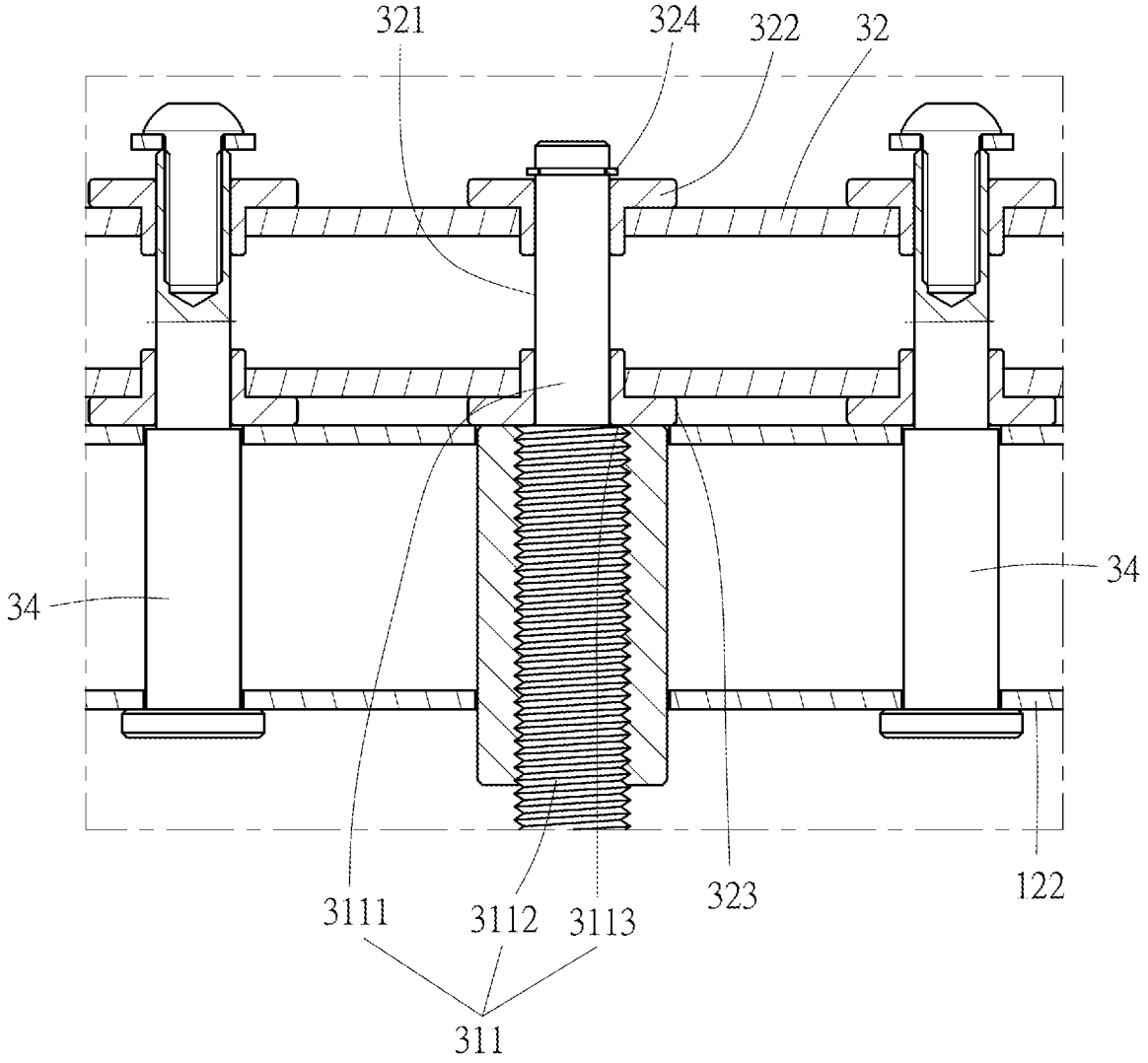
FIG. 5 is a partial enlarged view of the resistance unit of the present invention.

Referring to FIGS. 3, 4 and 5, the connecting member 12 has a U-shaped rod 121 and a horizontal rod 122. The U-shaped rod 121 has two end portions 1211. The horizontal rod 122 is fixed to the end portions 1211. The horizontal rod 122 has a first through hole 1221. The first through hole 1221 is provided with a nut 1222. The control member 31 is screwed in the nut 1222. The control member 31 is connected to the movable rod 32. Two sides of the control member 31 are provided with fixing members 34. The fixing member 34 connects the movable rod 32 and the horizontal rod 122 of the connecting member 12, such that when the control member 31 is turned, the movable rod 32 will not be turned along with the control member 31. The two resistance members 33 are disposed on two sides of the movable rod 32, respectively. Each turntable unit 2 further includes a rotating wheel 221. The rotating wheel 221 is locked to the turntable 22. The grip 23 is pivotally connected to the rotating wheel 221. The grip 23 has a height d. The height d is between 8 cm and 16 cm. The rotating wheel 221 is pivotally connected to the rotating shaft 21. The two rotating shafts 21 of the two turntable units 2 are pivotally connected to two sides of the horizontal rod 122, respectively.

Please refer to FIG. 4 and FIG. 5, the control member 31 has a control rod 311 and a control portion 312. The control rod 311 has an insertion portion 3111 and a threaded portion 3112. A stepped surface 3113 is defined between the insertion portion 3111 and the threaded portion 3112. The movable rod 32 has a second through hole 321. Two ends of the second through hole 321 are sleeved with a first bushing 322 and a second bushing 323, respectively. The threaded portion 3112 of the control rod 311 is screwed into the nut 1222. The insertion portion 3111 is inserted through the second bushing 323, the second through hole 321 and the first bushing 322, and extends out of the first bushing 322. The insertion portion 3111 is provided with a C-shaped retaining ring 324. The C-shaped retaining ring 324 is configured to secure the first bushing 322 and the movable rod 32, so that the insertion portion 3111 cannot be retracted to the second through hole 321. The insertion portion 3111 is in clearance fit with the second through hole 321. The stepped surface 3113 of the control rod 311 abuts against the second bushing 323. The two resistance members 33 of the resistance unit 3 correspond to the rotating wheels 221 of the two turntable units 2. The resistance member 33 may be a magnetic resistance member or a friction member. For example, the friction member may be wool felt or a brake pad. When the resistance member 33 is a magnetic resistance member, the rotating wheel 221 is a magnetic resistance wheel. In this embodiment, the two resistance members 33 are wool felt. The fixing member 34 passes through the movable rod 32 and the horizontal rod 122 of the connecting member 12. The fixing member 34 extends out of the movable rod 32.

Figure 6:
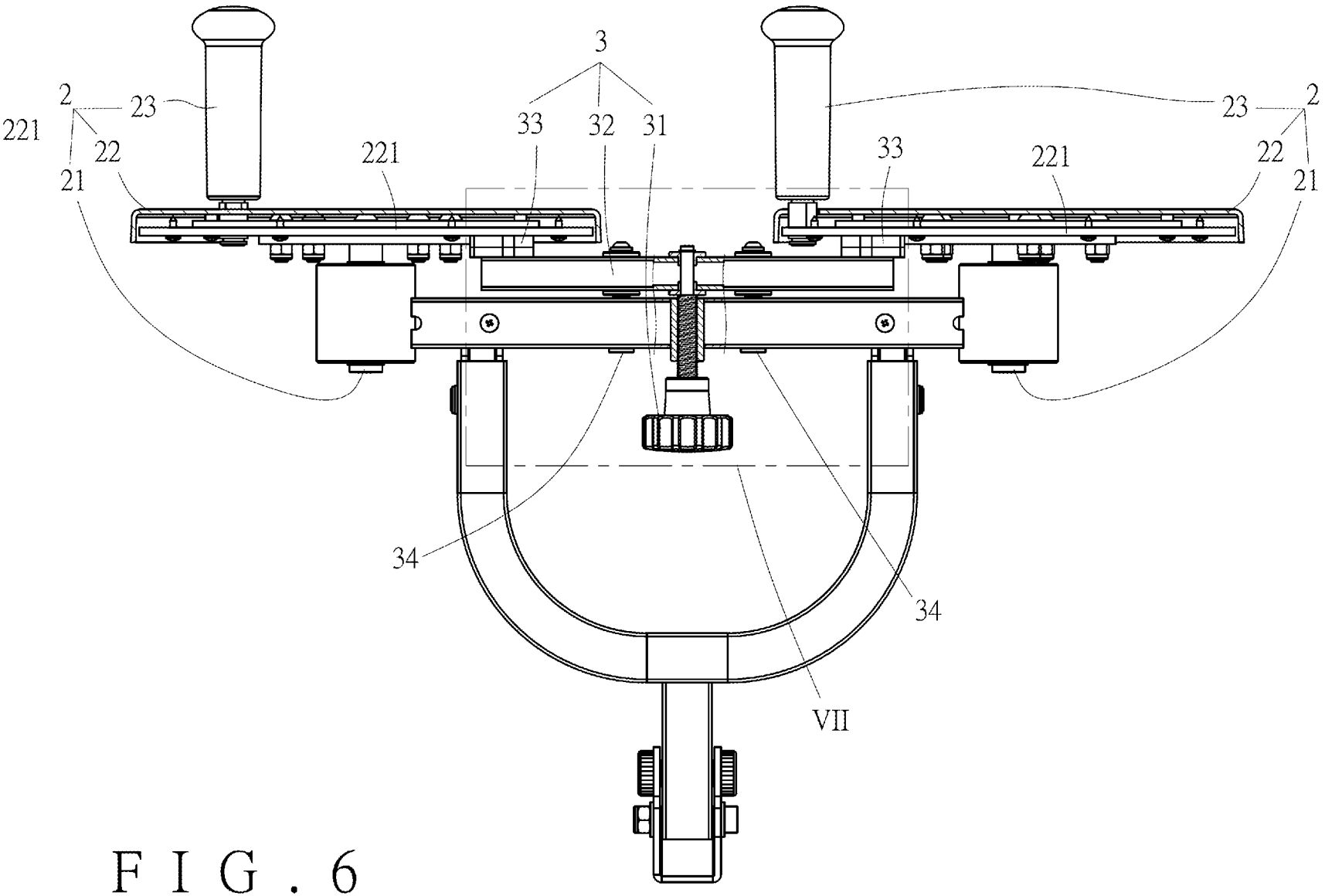
FIG. 6 is a schematic view showing the operation of the dual-turntable training device of the present invention.

Please refer to FIG. 3 and FIG. 4. When in use, the operator holds the two grips 23 to drive the two rotating wheels 221 to rotate, so that the turntables 22 and the rotating shafts 21 are rotated synchronously. When the two resistance members 33 of the resistance unit 3 are not in contact with the two rotating wheels 221, there is no rotational resistance effect. Please refer to FIG. 5 and FIG. 6. When the operator wants to increase the training intensity, the operator adjusts the control portion 312, such that the threaded portion 3112 of the control rod 311 is screwed into the nut 1222 and the insertion portion 3111 is idle in the second through hole 321 of the movable rod 32. When the stepped surface 3113 is moved out of the nut 1222, the stepped surface 3113 abuts against the second bushing 323, enabling the movable rod 32 to approach the rotating wheels 221. Through the two resistance members 33 of the movable rod 32 leaning against the two rotating wheels 221, the two resistance members 33 can apply rotation resistance to the two turntables 221. Due to the rotation resistance, the operator needs to exert greater force to rotate the two rotating wheels 221. At this time, the rotating wheels 221 have the greatest rotation resistance. When the operator wants to reduce the training intensity, the operator can adjust the control portion 312 to screw the threaded portion 3112 of the control rod 311 out of the nut 1222, and the insertion portion 3111 is idle in the second through hole 321 of the movable rod 32. When the stepped surface 3113 is moved into the nut 1222, the stepped surface 3113 is far away from the second bushing 323, and the C-shaped retaining ring 324 of the insertion portion 3111 drives the first bushing 322 to move the two resistance members 33 of the movable rod 32 away from the rotating wheels 221, so that the two resistance members 33 reduce the rotation resistance applied to the two turntables 221. The reduced rotation resistance allows the operator not to exert greater force to rotate the two rotating wheels 221. It should be noted that the operator can use the control portion 312 of the control member 31 to adjust the two resistance members 33 to move closer to or away from the rotating wheels 221 according to the training intensity required for training both hands to change the rotation resistance. With the height d of the grip 23, the operator can not only grasp the grip 23 with their fingers for training but also can hold the grip 23 in the palm of their hand for training.

Figure 7:
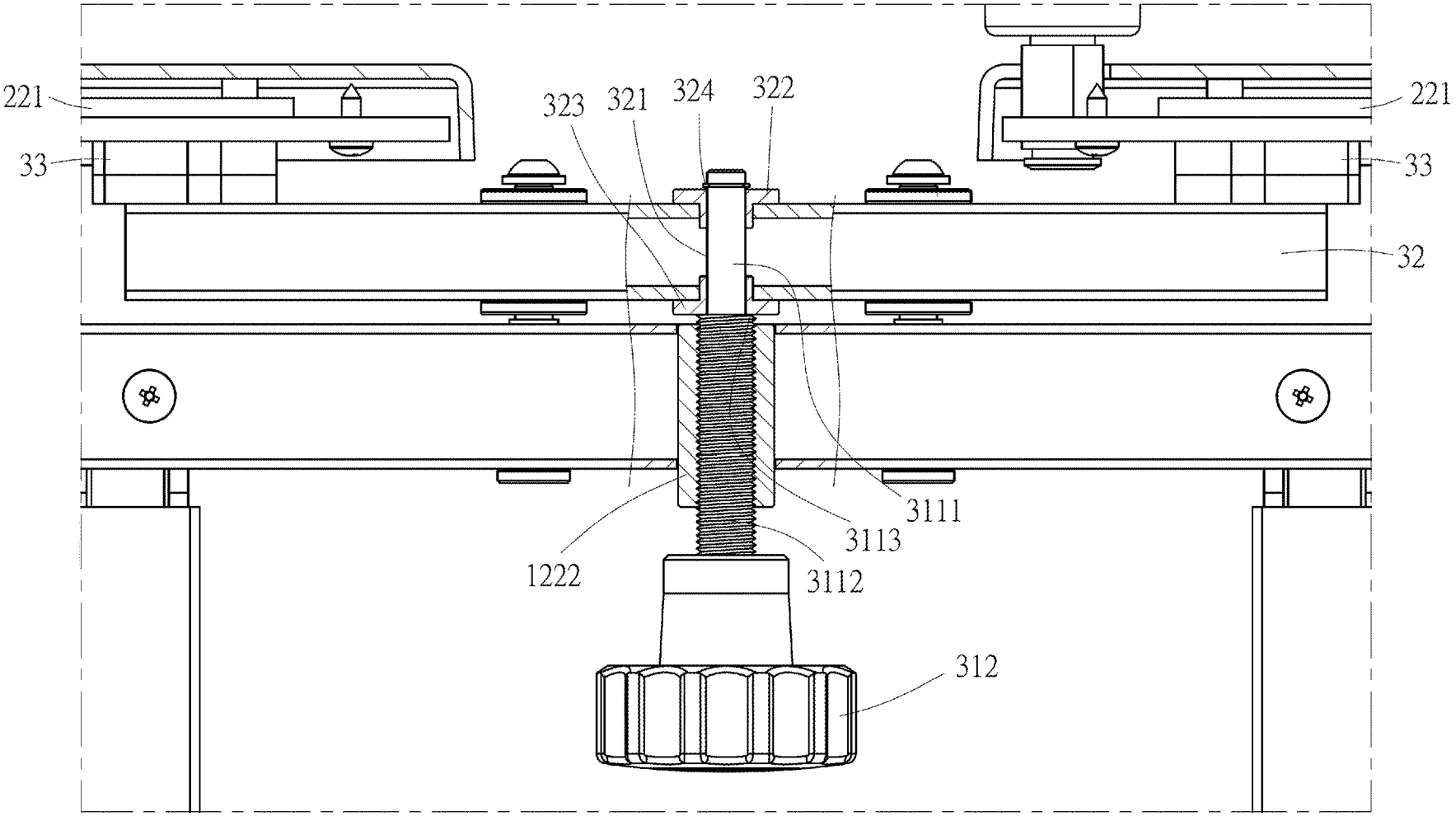
FIG. 7 is a partial enlarged view of the resistance unit and the turntable of the present invention.
Figure 8:
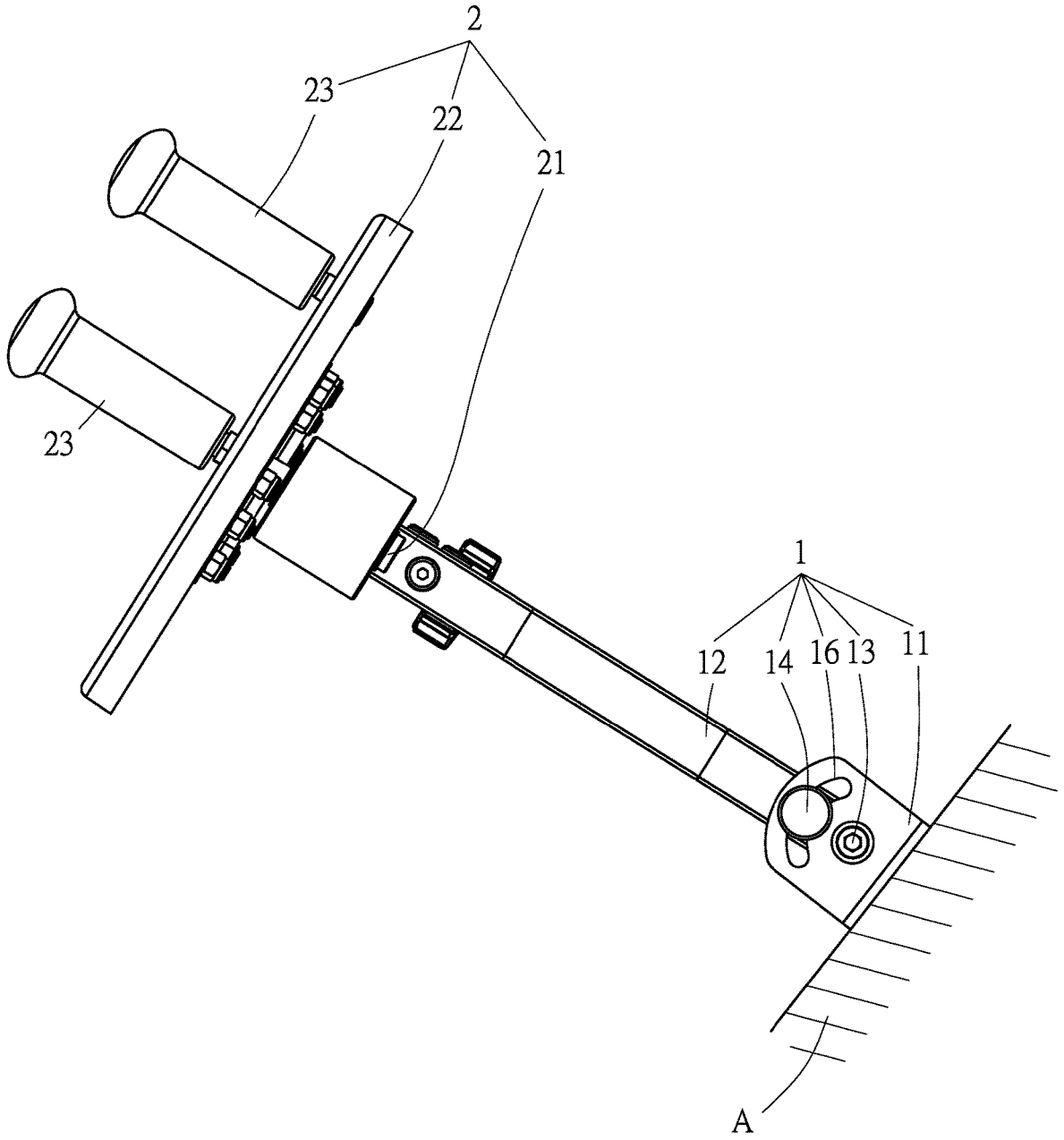
FIG. 8 is a side view of the dual-turntable training device of the present invention.
Figure 9:
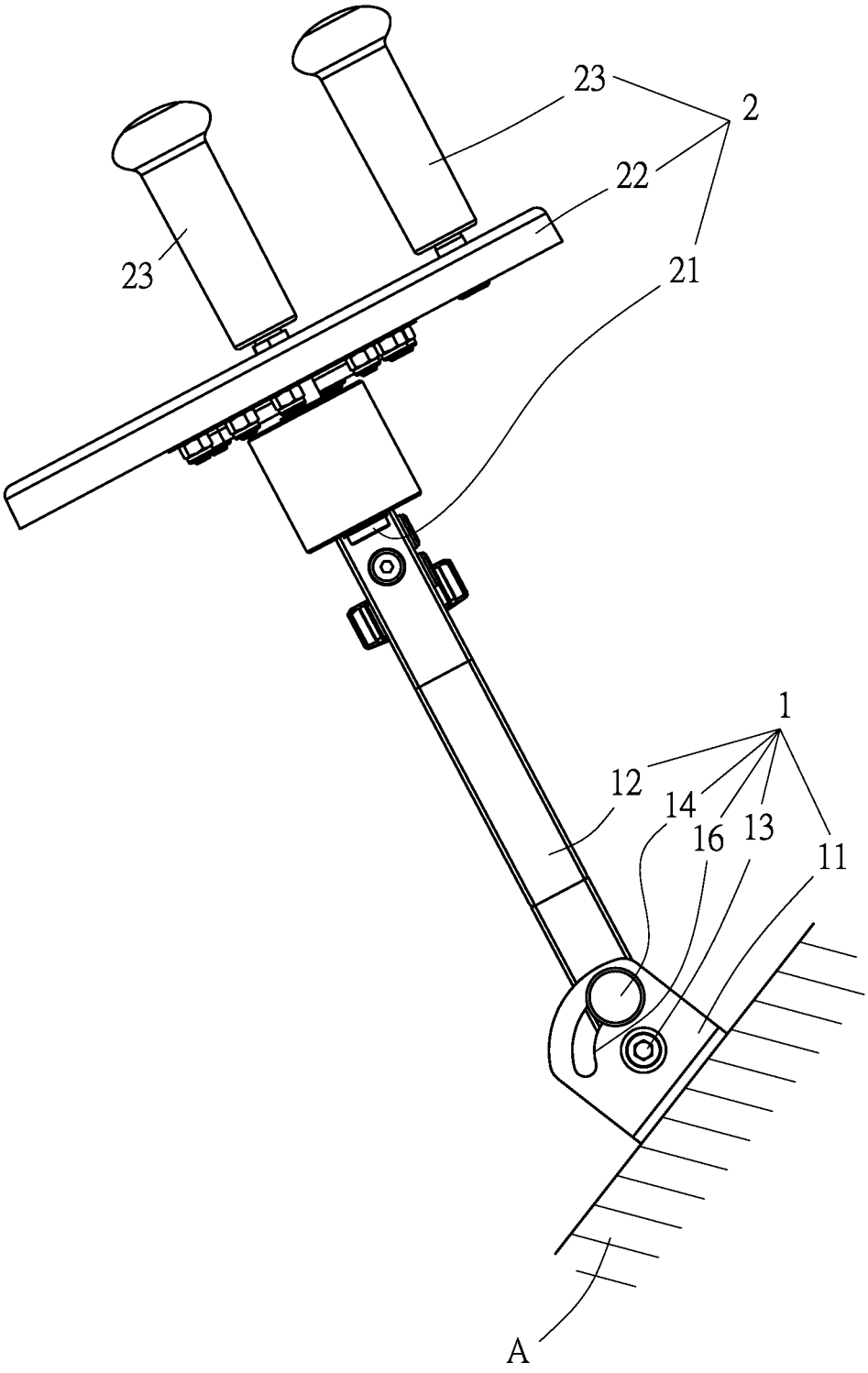
FIG. 9 is a schematic view of the present invention, showing that the dual-turntable training device is pivoted an angle.

Please refer to FIG. 1, FIG. 7, and FIG. 8. In this embodiment, the fixing seat 11 of the base 1 is arranged on an exercise device A. First, the operator loosens the screw 14 so that the connecting member 12 is confined by the screw 14 and displaces in the pivot grooves 16 to change the angle. When the operator adjusts the connecting member 12 to the desired angle, the screw 14 is screwed to the nut 15 to fix the connecting member 12 to the fixing seat 11 tightly.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A dual-turntable training device, comprising:

a base including a fixing seat and a connecting member, the connecting member being pivotally connected to the fixing seat through a pivot and having a U-shaped rod and a horizontal rod, the U-shaped rod having two end portions, the horizontal rod being fixed to the two end portions, the horizontal rod having a through hole, the through hole being provided with a nut;

two turntable units disposed on the connecting member and being disposed on two sides of the horizontal rod, each of the two turntable units including a rotating shaft, a turntable, and a grip vertically disposed on the turntable, the rotating shaft being pivoted to the base, the turntable being secured to the rotating shaft, the turntables of the two turntable units being horizontally arranged side by side;

a resistance unit including a control member and two resistance members, the control member being disposed on the base and being screwed into the nut, the control member being connected to the two resistance members, each of the two resistance members corresponding to a respective one of the two turntables of the two turntable units and being configured to apply rotation resistance thereto; by operating the control member, each of the two resistance members being moved closer to or away from the corresponding turntables for adjusting the rotation resistance, wherein responsive to the control member being screwed into the nut, each of the two resistance members are moved close to the corresponding turntables to generate the rotation resistance.

2. The dual-turntable training device as claimed in claim 1, wherein the pivot is pivoted to the fixing seat in a horizontal direction, and the pivot is arranged in a direction same as that of the turntables.

3. The dual-turntable training device as claimed in claim 1, wherein the resistance unit further includes a movable rod and a fixing member, the control member is connected to the movable rod, the two resistance members are disposed on two sides of the movable rod respectively, the fixing member is inserted through the horizontal rod and the movable rod, and when the control member is inserted into the nut, the movable rod cannot be turned.

4. The dual-turntable training device as claimed in claim 3, wherein the control member has a control portion and a control rod, the control rod has a threaded portion and an insertion portion, the threaded portion is screwed into the nut, the insertion portion is inserted through the movable rod, a stepped surface is defined between the threaded portion and the insertion portion, when the threaded portion is screwed into the nut by turning the control member, the insertion portion is idle relative to the movable rod, and the stepped surface is pushed against the movable rod to control each of the two resistance members to approach the corresponding turntables.

5. The dual-turntable training device as claimed in claim 1, wherein the grips vertically disposed on the turntables of the two turntable units are disposed thereon in a rotatable manner, and each of the grips have a height ranging from 8 cm to 16 cm.

6. The dual-turntable training device as claimed in claim 1, wherein the two resistance members are magnetic resistance members or friction members.

* * * * *